US012158139B2

(12) United States Patent
Hu et al.

(10) Patent No.: US 12,158,139 B2
(45) Date of Patent: Dec. 3, 2024

(54) PUMP BODY ASSEMBLY AND FLUID MACHINE

(71) Applicant: GREE ELECTRIC APPLIANCES, INC. OF ZHUHAI, Zhuhai (CN)

(72) Inventors: Yusheng Hu, Zhuhai (CN); Huijun Wei, Zhuhai (CN); Jia Xu, Zhuhai (CN); Zhongcheng Du, Zhuhai (CN); Liping Ren, Zhuhai (CN); Zhi Li, Zhuhai (CN)

(73) Assignee: GREE ELECTRIC APPLIANCES, INC. OF ZHUHAI, Zhuhai (CN)

( * ) Notice: Subject to any disclaimer, the term of this patent is extended or adjusted under 35 U.S.C. 154(b) by 0 days.

(21) Appl. No.: 18/151,665

(22) Filed: Jan. 9, 2023

(65) Prior Publication Data

US 2023/0160376 A1 May 25, 2023

Related U.S. Application Data

(63) Continuation of application No. PCT/CN2021/110103, filed on Aug. 2, 2021.

(30) Foreign Application Priority Data

Dec. 29, 2020 (CN) ..... 202011590433.9

(51) Int. Cl.
*F04B 27/08* (2006.01)
*F01C 1/22* (2006.01)
(Continued)

(52) U.S. Cl.
CPC ..... *F04B 27/0878* (2013.01); *F04B 7/06* (2013.01); *F04B 27/0821* (2013.01);
(Continued)

(58) Field of Classification Search
CPC .. F04B 27/0878; F04B 27/0821; F04B 53/14; F04C 29/028; F04C 29/02; F04C 2240/20; F04C 2240/60
See application file for complete search history.

(56) References Cited

U.S. PATENT DOCUMENTS

2014/0219845 A1 8/2014 Hugenroth et al.
2019/0316586 A1 10/2019 Huang et al.

FOREIGN PATENT DOCUMENTS

CN 107165822 A 9/2017
CN 106015009 B 8/2018
(Continued)

OTHER PUBLICATIONS

English Machine Translation of CN108799108A translated by USPTO Fit Datebase on May 7, 2024 (Year: 2018).*
(Continued)

*Primary Examiner* — Bryan M Lettman
*Assistant Examiner* — Paul W Thiede
(74) *Attorney, Agent, or Firm* — Westbridge IP LLC

(57) ABSTRACT

Disclosed are a pump body assembly and a fluid machine. The pump body assembly includes a rotation shaft and a piston provided with a sliding hole, at least a portion of the rotation shaft penetrates into the sliding hole, during rotation of the piston with the rotation shaft, and the sliding hole is in sliding fit with the rotation shaft, the piston is provided with a piston communication passage communicated with the sliding hole. The pump body assembly can solve the problem that the piston impedes a flow of oil liquid during use of a rotary cylinder compressor.

13 Claims, 15 Drawing Sheets

(51) Int. Cl.

| | |
|---|---|
| ***F01C 17/06*** | (2006.01) |
| ***F04B 7/06*** | (2006.01) |
| ***F04B 53/14*** | (2006.01) |
| ***F04C 18/02*** | (2006.01) |
| ***F04C 29/02*** | (2006.01) |
| *F04C 18/22* | (2006.01) |
| *F04C 29/00* | (2006.01) |

(52) U.S. Cl.
CPC ..... *F04B 53/14* (2013.01); *F04C 29/028* (2013.01); *F01C 1/22* (2013.01); *F01C 17/06* (2013.01); *F04C 18/22* (2013.01); *F04C 29/00* (2013.01); *F04C 29/02* (2013.01); *F04C 2240/20* (2013.01); *F04C 2240/60* (2013.01)

(56) References Cited

FOREIGN PATENT DOCUMENTS

| | | | | |
|---|---|---|---|---|
| CN | 108799108 | A | 11/2018 | |
| CN | 109595170 | A | 4/2019 | |
| CN | 209414159 | U | 9/2019 | |
| CN | 110905809 | A | 3/2020 | |
| CN | 111022321 | A | 4/2020 | |
| CN | 212717171 | U | 3/2021 | |
| JP | 2000179472 | A | 6/2000 | |
| JP | 2004251129 | A | 9/2004 | |
| JP | 4989269 | B2 | 8/2012 | |
| WO | WO-2020125093 | A1 * | 6/2020 | ..... F04C 18/344 |

OTHER PUBLICATIONS

European Search Report issued in counterpart European Patent Application No. EP 21913086.1, dated Feb. 12, 2024.
International Search Report issued in corresponding PCT Application No. PCT/CN2021/110103, dated Sep. 27, 2021.

* cited by examiner

PUMP BODY ASSEMBLY AND FLUID MACHINE

CROSS-REFERENCE TO RELATED APPLICATIONS

This application is a continuation of International Application No. PCT/CN2021/110103, filed on Aug. 2, 2021, which claims priority to Chinese application No. 202011590433.9, filed on Dec. 29, 2020. All of the aforementioned applications are incorporated herein by reference in their entireties.

TECHNICAL FIELD

The present disclosure relates to a technical field related to rotary cylinder compressors, and specifically to a pump body assembly and a fluid machine.

BACKGROUND

Taking a rotary cylinder compressor as an example, it is a new type of volumetric compressor. Its cylinder and rotation shaft rotate around their respective centers, and the piston reciprocates with respect to the cylinder and the rotation shaft at the same time. The reciprocating motion of the piston with respect to the cylinder enables periodical enlarging and reducing of the volume cavity; the circular motion with respect to the cylinder sleeve enables communication of the volume cavity with the intake passage and the exhaust passage, respectively. The above two motions cooperate to enable the intake, compression and exhaust processes of the compressor.

With the higher and higher requirement of high efficiency and energy saving for compressors, it is necessary to optimize the design of the rotary cylinder compressor to further improve efficiency of the compressor and achieve energy saving and emission reduction. Currently, during running of a rotary cylinder compressor, the rotation shaft divides the sliding hole in the piston into two cavities, and when the rotation shaft of the pump body assembly is sliding with respect to the piston, the two cavities of the sliding hole increase and decrease periodically. and the inner wall of the sliding hole of the piston presses the oil liquid in the sliding hole such that the oil liquid is transferred within the two cavities to achieve the oil pressing process. However, during practical running of a compressor, when the inner wall of the sliding hole of the piston presses the oil liquid, the fluency of the oil liquid will be impeded. During the oil pressing process, the oil liquid causes increase in power consumption of the piston and the rotation shaft, resulting in an increase in power consumption of the pump body assembly of the rotary cylinder compressor.

Currently, as described above, there is a problem in that the piston impedes a flow of oil liquid during use of rotary cylinder compressors.

SUMMARY

The main purpose of the present disclosure is to provide a pump body assembly and a fluid machine to solve the problem in prior art that the piston impedes a flow of oil liquid during use of rotary cylinder compressors.

In order to achieve the above purpose, according to an aspect of the present disclosure, a pump body assembly is provided, comprising a rotation shaft and a piston provided with a sliding hole, at least a portion of the rotation shaft penetrates into the sliding hole, during rotation of the piston with the rotation shaft, the sliding hole is in sliding fit with the rotation shaft, wherein the piston is provided with a piston communication passage communicated with the sliding hole.

In some embodiments, a plurality of the piston communication passages are provided, the plurality of the piston communication passages are disposed on a hole wall face of the sliding hole and/or the plurality of the piston communication passages are disposed on an end face of the piston in an axial direction of the rotation shaft.

In some embodiments, the number of the piston communication passages is less than 4.

In some embodiments, the sliding hole is provided on its hole wall face with a piston communication groove, and the piston communication groove extends in a sliding direction of the piston and constitutes the piston communication passage.

In some embodiments, the piston communication groove has a uniform depth from place to place.

In some embodiments, in the sliding direction of the piston, the piston communication groove has a depth H2 gradually increasing from both ends of the piston communication groove towards a middle portion of the piston communication groove.

In some embodiments, the piston communication groove is a groove in a crescent shape.

In some embodiments, in an axial direction of the rotation shaft, the piston is provided on its end face with a piston communication groove, and the piston communication groove extends in a sliding direction of the piston and constitutes the piston communication passage.

In some embodiments, on the end face of the same end of the piston, a group of two opposite edges of the sliding hole is respectively provided with at least one piston communication groove.

In some embodiments, in the axial direction of the rotation shaft, the piston is provided, at each of its top end face and its bottom end face, with the piston communication groove.

In some embodiments, with the piston communication groove as a boundary, the end face on a side where the piston communication groove is located comprises a first surface P1 and a second surface P2, wherein the first surface P1 is in a region between the piston communication groove and an edge of the sliding hole on the side where the piston communication groove is located, and the second surface P2 is in a region between the piston communication groove and an outer edge of the piston.

In some embodiments, a difference in height between the first surface P1 and the second surface P2 equals to 0.1 mm.

In some embodiments, a distance L2 between the piston communication groove and an outer edge of the end face of the piston on a side where the piston communication groove is located is greater than or equal to 2 mm.

In some embodiments, the sliding hole of the piston is further provided therein with a flexible groove, the flexible groove extends in the axial direction of the rotation shaft, and the flexible groove is communicated at its end with the piston communication groove.

In some embodiments, the flexible groove is located at an end of the piston communication groove.

In some embodiments, a plurality of the flexible grooves are provided, and both ends of the same piston communication groove are respectively provided with one flexible groove such that a sliding boss protruding from the hole wall face of the sliding hole is formed within the sliding hole.

In some embodiments, a surface of the sliding boss facing towards a middle portion of the sliding hole is a sliding face.

In some embodiments, the sliding face is a plane.

In some embodiments, in the axial direction of the rotation shaft, the flexible groove has its ends penetrating through the end faces on both ends of the piston.

In some embodiments, the flexible groove has a length H3 greater than or equal to 2 mm and less than or equal to 7 mm.

In some embodiments, an included angle A between a surface of the flexible groove near a middle portion of the sliding hole and the hole wall face on a side where the flexible groove is located in the sliding hole ranges from 10° to 30°.

In some embodiments, the flexible groove comprises a first groove surface and a second groove surface, which are connected in sequence, in a direction close to a middle portion of the sliding hole; a first transition fillet angle 1 is formed between the first groove surface and the hole wall face of the sliding hole, a second transition fillet angle 2 is formed between the second groove surface and the first groove surface, and a third transition fillet angle 3 is formed at an edge on a side of the second groove surface far away from first groove surface.

In some embodiments, the first transition fillet angle 1 is 0.3°-1°, and/or the second transition fillet angle 2 is 0.3°-1°, and/or the third transition fillet angle 3 is 0.5°-3°.

In some embodiments, the piston communication groove has a width H1 accounting for 1%-12% of a width W1 of the piston.

In some embodiments, the piston communication groove has a depth H2 accounting for 3%-50% of a width W1 of the piston.

In some embodiments, the pump body assembly further comprises a cylinder sleeve and a cylinder, wherein the cylinder is rotatably arranged in the cylinder sleeve and is provided thereon, in its radial direction, with a piston hole, the piston is slidably arranged in the piston hole, the rotation shaft penetrates through the piston and drives the piston to reciprocate in an extension direction of the piston hole, and the cylinder rotates to cause rotation of the piston.

According to another aspect of the present disclosure, a fluid machine is provided, comprising the pump body assembly.

With the technical solutions of the present disclosure, the pump body assembly comprises a rotation shaft and a piston provided with a sliding hole, with at least a portion of the rotation shaft penetrating into the sliding hole, during rotation of the piston with the rotation shaft, the sliding hole is in sliding fit with the rotation shaft, wherein the piston is provided with a piston communication passage communicated with the sliding hole.

As can be seen from the above description, in the above embodiment(s) of the present disclosure, by setting the piston communication passage in the sliding hole of the piston, the fluency of oil liquid flow is increased and the power consumption of the pump body assembly is reduced. Currently, during running of a rotary cylinder compressor, when the rotation shaft of the pump body assembly is sliding with respect to the piston, an inner wall of the sliding hole of the piston will impede fluency of oil liquid flow when pressing the oil liquid and cause increase in power consumption of the pump body assembly.

Specifically, the rotation shaft penetrates through the sliding hole on the piston and divides the portion inside the piston into two cavities. During movement of the pump body assembly, the piston reciprocates with respect to the rotation shaft, and the two cavities increase and decrease periodically to achieve the oil pressing process. During the reciprocating movement of the piston, the inner wall of the sliding hole of the piston will press the oil liquid to enable transfer of the oil liquid between the two cavities. The piston communication passage communicated with the sliding hole is disposed on the piston so as to improve fluency of oil liquid transfer, to decrease resistance to pressing oil liquid by the piston, to reduce power consumption of the rotation shaft and the piston during the oil pressing process, and to reduce power consumption of the pump body assembly.

BRIEF DESCRIPTION OF THE DRAWINGS

The accompanying drawings for the description, which constitutes a portion of the present application, are used to provide further understanding to the present disclosure. The illustrative embodiments of the present disclosure and the description thereof are used to explain the present disclosure, rather than forming inappropriate limitation to the present disclosure. In the drawings/figures.

DETAILED DESCRIPTIONS OF THE EMBODIMENTS

Figure 1:
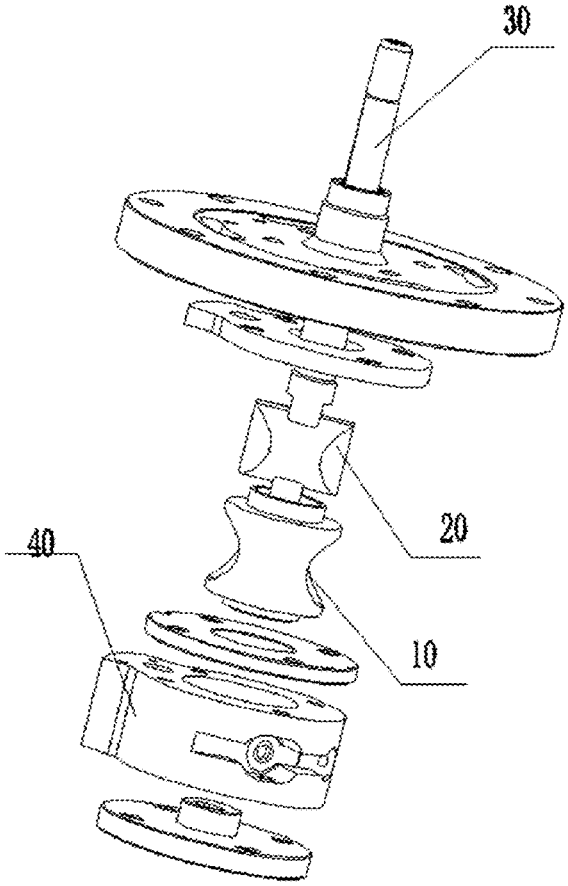
FIG. 1 shows an exploded view of a pump body assembly in the present disclosure.
Figure 2:
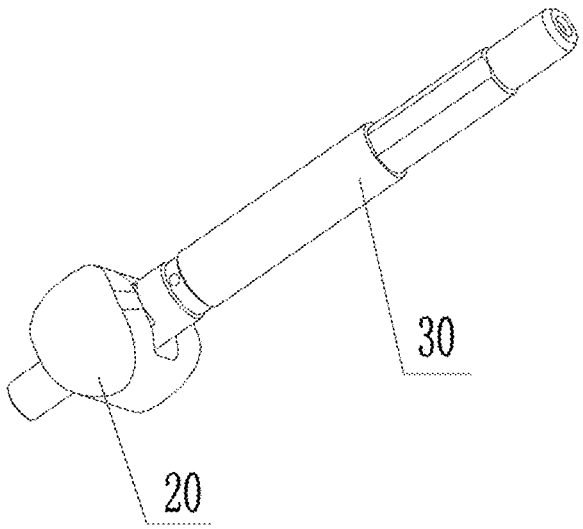
FIG. 2 shows a diagram for mounting relation of a rotation shaft and a piston in FIG. 1.

It should be noted that the embodiments in the present application and the features therein can be combined with one another if there is no contradiction. Hereinafter, the present disclosure will be explained in detail with reference to the accompanying drawings and in combination with the embodiments.

It should be pointed out that any technical or scientific term used in the present application has the same meaning as generally understood by those skilled in the art of the present application, unless otherwise specified.

In the present disclosure, the used direction-position expressions, such as "above", "below", "top", "bottom", are generally used with respect to the direction(s) as shown in the figures, or with respect to the vertical, perpendicular or gravity direction for a part per se, unless specified on the contrary. Similarly, in order to facilitate understanding and description, the expressions of "inner" and "outer" refer to inner and outer portions of contours of parts per se. However, the above direction-position expressions are not used to limit the present disclosure.

In order to solve the problem in prior art that oil liquid flow is impeded during use of rotary cylinder compressors due to structures of a cylinder 10, a piston 20, a rotation shaft 30 and a flange, a pump body assembly and a fluid machine are provided in the present application.

Herein, the fluid machine comprises the pump body assembly as described below. Specifically, the fluid machine is a compressor. In some embodiments, the compressor is a rotary cylinder compressor.

In order to solve the problem in the prior art of impediment to oil liquid flow during use of rotary cylinder compressors, it is possible to optimize the piston 20 so as to reduce impediment of the piston 20 to the oil liquid, thereby reducing power consumption of the pump body assembly.

Specifically, as shown in FIGS. 1-10, a pump body assembly comprises a rotation shaft 30 and a piston 20 provided with a sliding hole 2011, at least a portion of the rotation shaft 30 penetrates into the sliding hole 2011, wherein during rotation of the piston 20 with the rotation shaft 30, the sliding hole 2011 is in sliding fit with the rotation shaft 30. The piston 20 is provided with a piston communication passage communicated with the sliding hole 2011.

As can be seen from the above description, in the above embodiment of the present disclosure, a piston communication passage is provided inside the sliding hole 2011 of the piston 20 so as to improve fluency of oil liquid flow and reduce power consumption of the pump body assembly. Currently, during running of a rotary cylinder compressor, when the rotation shaft 30 of the pump body assembly is sliding with respect to the piston 20, an inner wall of the sliding hole 2011 of the piston 20 will impede fluency of oil liquid flow when pressing the oil liquid and cause increase in power consumption of the pump body assembly.

Specifically, the rotation shaft 30 penetrates into the sliding hole 2011 on the piston 20 and divides the portion inside the piston 20 into two cavities. During movement of the pump body assembly, the piston 20 reciprocates with respect to the rotation shaft 30, and the two cavities increase and decrease periodically to achieve the oil pressing process. During the reciprocating movement of the piston 20, the inner wall of the sliding hole 2011 of the piston 20 will press the oil liquid to enable transfer of the oil liquid between the two cavities. The piston communication passage communicated with the sliding hole 2011 is disposed on the piston 20 so as to improve fluency of oil liquid transfer, to decrease resistance to pressing oil liquid by the piston 20, to reduce power consumption of the rotation shaft 30 and the piston 20 during the oil pressing process, and to reduce power consumption of the pump body assembly.

In some embodiments, the number of the piston communication passages is less than 4. If the number of the piston communication passages is more than 4, the strength of the piston 20 will be affected, which will lead to insufficient stability of the piston 20 and decreased oil pressing power, and thus affect the whole running efficiency of the pump body assembly.

It should be noted that in the specific embodiments as shown in FIGS. 3-10, there are various implementations according to the difference(s) in the position(s) provided for the piston communication passage(s) and the shape(s) of the piston communication passage(s) as long as the impediment to oil liquid during the oil pressing process due to the piston 20 can be reduced, and they will not be described herein one by one.

Hereinafter, according to different structures for the piston communication passages disposed on the piston 20, various implementations in FIGS. 3-10 are provided.

Figure 3:
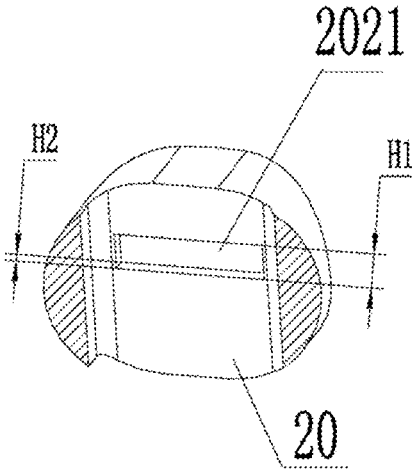
FIG. 3 shows a diagram of a piston communication groove disposed on a hole wall face of a sliding hole of the piston in the present disclosure wherein the piston communication groove is a rectangular groove.

In a specific implementation as shown in FIG. 3, a piston communication passage is disposed on a hole wall face of the sliding hole 2011. The piston communication passage is a rectangular piston communication groove 2021 having a uniform depth from place to place.

Specifically, by setting a rectangular piston communication groove 2021 on the hole wall face of the sliding hole 2011 of the piston 20, the piston communication groove 2021 extends in the sliding direction of the piston 20 and constitutes the piston communication passage, thus enlarging the flow path of the oil liquid. When the hole wall face of the sliding hole 2011 of the piston 20 presses the oil liquid, the oil liquid can be transferred via the piston communication groove 2021, improving fluency of oil liquid transfer and also reducing power consumption of the piston 20 and the rotation shaft 30 during the oil pressing process.

Figure 4:
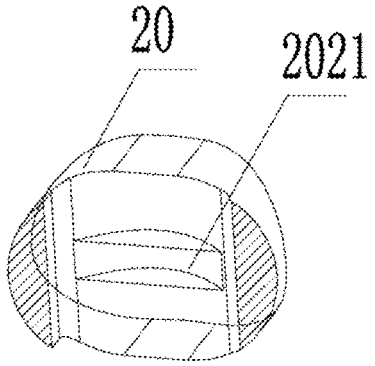
FIG. 4 shows a diagram of a piston communication groove disposed on a hole wall face of a sliding hole of the piston in the present disclosure wherein the piston communication groove is a groove in a crescent shape.

In a specific implementation as shown in FIG. 4, a piston communication passage is disposed on a hole wall face of the sliding hole 2011. The piston communication passage is a piston communication grooves 2021 in a crescent shape.

It should be noted that in the sliding direction of the piston 20, the piston communication groove 2021 has a depth H2 gradually increasing from both ends of the piston communication groove 2021 towards a middle portion of the piston communication groove 2021, thus forming the piston communication groove 2021 in a crescent shape.

Specifically, by setting a piston communication groove 2021 in a crescent shape on the hole wall face of the sliding hole 2011 of the piston 20, the piston communication groove 2021 extends in the sliding direction of the piston 20 and constitutes the piston communication passage, thus enlarging the flow path of the oil liquid. When the hole wall face of the sliding hole 2011 of the piston 20 presses the oil liquid, the oil liquid can be transferred via the piston communication groove 2021, improving fluency of oil liquid transfer and also reducing power consumption of the piston 20 and the rotation shaft 30 during the oil pressing process.

In specific implementations as shown in FIGS. 5-8, a plurality of the piston communication passages are provided, the plurality of the piston communication passages are disposed on an end face of the piston 20 in an axial direction of the rotation shaft 30. The piston communication passage is the piston communication groove 2021.

In some embodiments, the piston communication groove 2021 extends in a sliding direction of the piston 20 and constitutes the piston communication passage.

Specifically, by setting the piston communication passage on an end face of the piston 20 in an axial direction of the rotation shaft 30, the flow path of the oil liquid is enlarged. When the hole wall face of the sliding hole 2011 of the piston 20 presses the oil liquid, the oil liquid can be transferred via the piston communication groove 2021, improving fluency of oil liquid transfer and also reducing power consumption of the piston 20 and the rotation shaft 30 during the oil pressing process.

As shown in FIGS. 5-8, on the end face of the same end of the piston 20, a group of two opposite edges of the sliding hole 2011 is respectively provided with at least one piston communication groove 2021. By setting the piston communication groove 2021 at the two edges in opposite positions of the sliding hole 2011, when the piston 20 presses the oil liquid, the oil liquid can be transferred via the piston communication groove 2021, improving movement fluency of oil liquid and reducing power consumption of the pump body assembly.

As shown in FIGS. 5-8, in the axial direction of the rotation shaft 30, the piston 20 is provided, at each of its top end face and its bottom end face, with the piston communication groove 2021. The piston communication groove 2021 is disposed at each of the top end face and the bottom end face of the piston 20, to enlarge the flow path of the oil liquid. When the inner wall of the sliding hole 2011 of the piston 20 presses the oil liquid, the movement fluency of oil liquid is improved and the power consumption of the pump body assembly is reduced.

Figure 7:
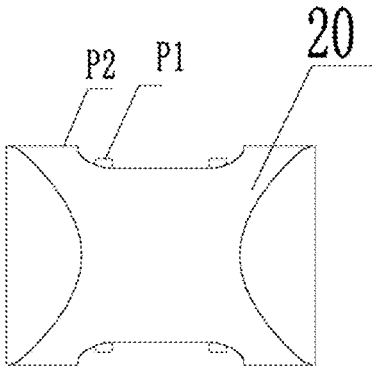
FIG. 7 shows a side view of FIG. 5.
Figure 8:
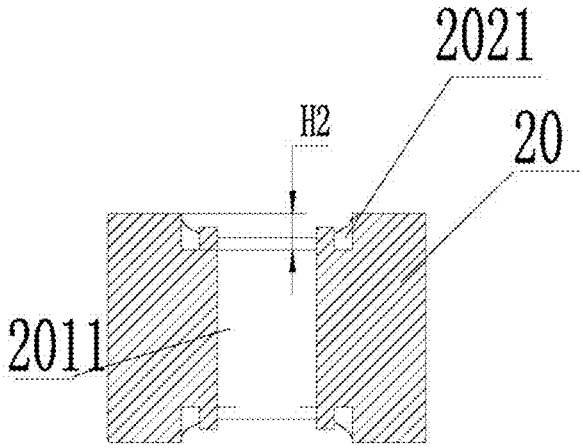
FIG. 8 shows an axial section view of FIG. 7.

As shown in FIG. 7, with the piston communication groove 2021 as a boundary, the end face on a side where the piston communication groove 2021 is located comprises a first surface P1 and a second surface P2, wherein the first surface P1 is in a region between the piston communication groove 2021 and an edge of the sliding hole 2011 on a side where the piston communication groove 2021 is located, and the second surface P2 is in a region between the piston communication groove 2021 and an outer edge of the piston 20. Thus, during movement of the piston 20, the second surface P2 will not contact the cylinder, thereby preventing friction.

Specifically, a difference in height between the first surface P1 and the second surface P2 is 0.1 mm. When the difference in height is greater than 0.1 mm, it is possible to affect the strength of the piston 20 due to the difference in height being too large. When difference in height is less than 0.1 mm, the flowability of oil liquid cannot be effectively improved and the power consumption of the pump body assembly during the oil pressing process cannot be reduced.

Figure 6:
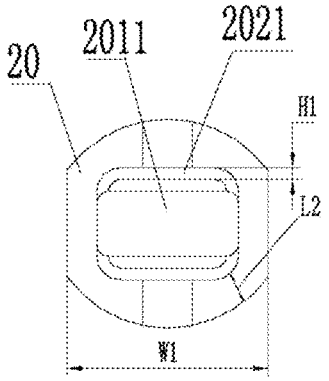
FIG. 6 shows a top view of FIG. 5.

As shown in FIG. 6, a distance L2 between the piston communication groove 2021 and an outer edge of the end face of the piston 20 on a side where the piston communication groove 2021 is located is greater than or equal to 2 mm. When the distance between the piston communication groove 2021 and an outer edge of the end face of the piston 20 on a side where the piston communication groove 2021 is located is less than 2 mm, the strength of the piston 20 will be affected due to the wall thickness of the piston 20 being too small, the piston 20 is prone to be damaged during running such that the pump body assembly cannot operate normally.

Figure 9:
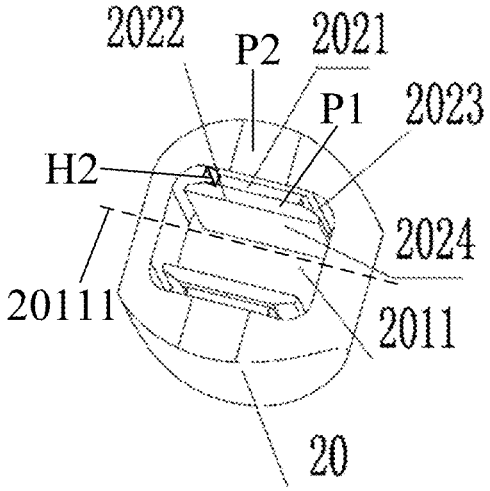
FIG. 9 shows a diagram of a piston communication groove and a flexible groove disposed on an end face of the piston in the present disclosure.
Figure 10:
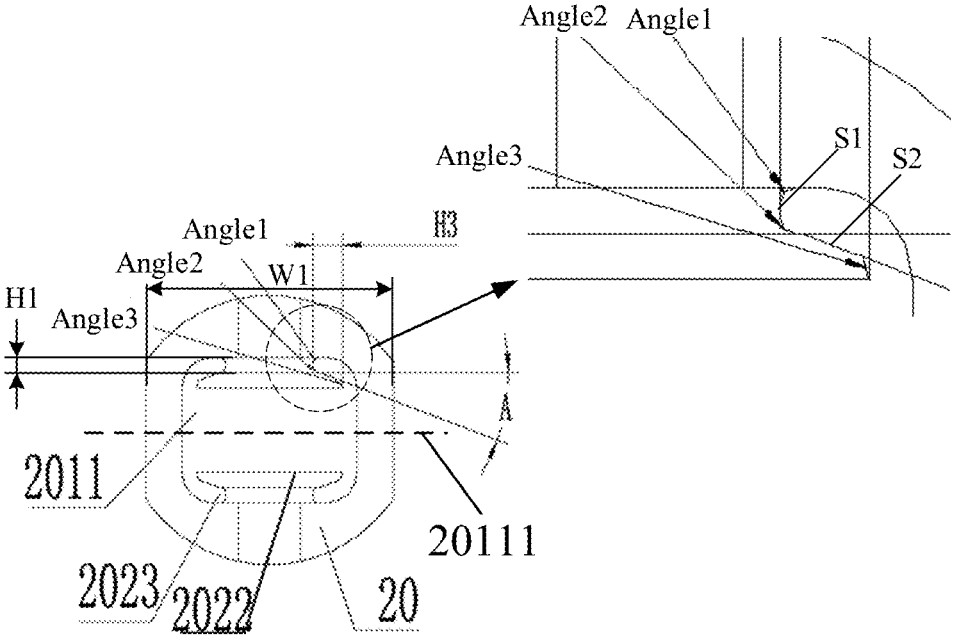
FIG. 10 shows a top view of FIG. 9.

In specific implementations as shown in FIGS. 9-10, a plurality of the piston communication passages are provided, the plurality of the piston communication passages are disposed on an end face of the piston 20 in an axial direction of the rotation shaft 30. The piston communication passage is a combined structure of the piston communication groove 2021 and the flexible groove 2023, wherein the flexible groove 2023 is disposed within the sliding hole 2011 of the piston 20 and is located at an end of the piston communication groove 2021.

In some embodiments, the flexible groove 2023 extends in the axial direction of the rotation shaft 30, and the flexible groove 2023 is communicated at its end with the piston communication groove 2021.

Specifically, by setting the piston communication groove 2021 and the flexible groove 2023 in the sliding hole 2011 of the piston 20, the flow path of the oil liquid is enlarged. When the sliding hole 2011 of the piston 20 presses the oil liquid, the fluency of oil liquid transfer can be improved to reduce impediment of oil liquid to the piston 20 and the rotation shaft 30, and the power consumption of the pump body assembly is reduced.

As shown in FIGS. 9-10, a plurality of the flexible grooves 2023 are provided, and both ends of the same piston communication groove 2021 are respectively provided with one flexible groove 2023, wherein in the axial direction of the rotation shaft 30, the ends of the flexible groove 2023 go through the end faces on both ends of the piston 20, such that a sliding boss 2022 protruding from the hole wall face of the sliding hole 2011 is formed within the sliding hole 2011.

Specifically, a surface of the sliding boss 2022 facing towards a middle portion 20111 of the sliding hole 2011 is a sliding face 2024. The sliding face 2024 is a plane. During running of the pump body assembly, the sliding face 2024 and the rotation shaft 30 are in sliding fit with each other to achieve the oil pressing process. By cooperation of the piston communication groove 2021 and the flexible groove 2023, the fluency of oil liquid transfer is improved, the impediment of oil liquid to the piston 20 and the rotation shaft 30 is reduced, and the power consumption of the pump body assembly is reduced.

As shown in FIG. 10, the flexible groove 2023 has a length H3 greater than or equal to 2 mm and less than or equal to 7 mm. When the length H3 of the flexible groove

2023 is less than 2 mm, the flexible groove 2023 is too small and thus is not conducive to improve the fluency of oil liquid. When the length H3 of the flexible groove 2023 is greater than 7 mm, the strength of the sliding boss 2022 is affected and the sliding boss 2022 is prone to be damaged during sliding fit with the rotation shaft 30.

As shown in FIG. 10, an included angle A between a surface of the flexible groove 2023 near a middle portion 20111 of the sliding hole 2011 and the hole wall face on a side where the flexible groove 2023 is located in the sliding hole 2011 ranges from 10° to 30°. If the included angle A is too large, the strength of the portion where the flexible groove 2023 on the sliding boss 2022 is located will be affected, and the sliding boss 2022 is prone to be damaged during sliding fit with the rotation shaft 30. If the included angle A is too small, it can't improve the fluency of oil liquid transfer, reduce impediment of oil liquid to the piston 20 and the rotation shaft 30, and reduce power consumption of the pump body assembly.

As shown in FIG. 10, the flexible groove 2023 comprises a first groove surface S1 and a second groove surface S2 which are connected in sequence in a direction close to a middle portion 20111 of the sliding hole 2011, a first transition fillet angle 1 is formed between the first groove surface S1 and the hole wall face of the sliding hole 2011, a second transition fillet angle 2 is formed between the second groove surface S2 and the first groove surface S1, and a third transition fillet angle 3 is formed at an edge on a side of the second groove surface S2 far away from first groove surface S1.

Specifically, the first transition fillet angle 1 is 0.3°-1°, the second transition fillet angle 2 is 0.3°-1°, and the third transition fillet angle 3 is 0.5°-3°. By setting the fillet and the corresponding angle ranges, the flowability of oil liquid is improved and the power consumption of the pump body assembly is reduced, without affecting the strength of the sliding boss 2022. The disposed fillet facilitates reducing the concentrated stress on the sliding boss 2022 and enables stable running during the oil pressing process.

It should be noted that the piston 20 may also be formed by 3D printing technology, with a large hollow inside as machined and an outer housing, which cannot be formed by general machining. The inner wall of the sliding hole 2011 is provided with a piston communication groove 2021 in an irregular shape. The piston communication groove 2021 has a first width equal to 12%-70% of a width W1 of the piston 20, the piston communication groove 2021 has a second width equal to 1%-12% of a width W1 of the piston 20, and the piston communication groove 2021 has a wall thickness of 2 mm-4 mm.

As shown in FIG. 6, the piston communication groove 2021 has a width H1 accounting for 1%-12% of a width W1 of the piston 20. Specifically, when the width H1 of the piston communication groove 2021 is too small, the fluency of oil liquid transfer during the oil pressing process cannot be effectively improved and the effect of reduction in power consumption of the pump body assembly cannot be achieved. When the width H1 of the piston communication groove 2021 is too large, the strength of the rotation shaft 30 will be affected, and the rotation shaft 30 is prone to break during its movement with respect to the piston 20.

Figure 5:
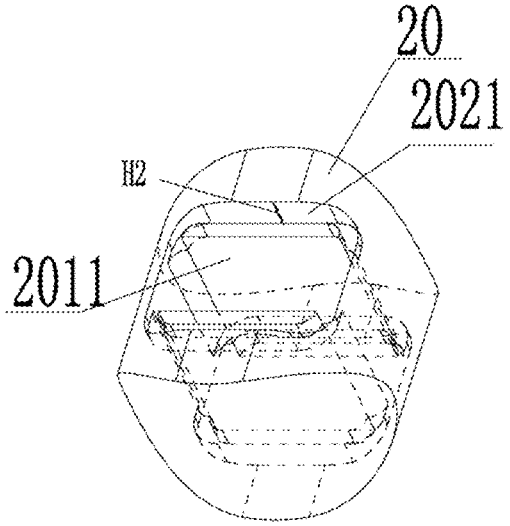
FIG. 5 shows a diagram of a piston communication groove disposed on an end face of the piston in the present disclosure.

As shown in FIGS. 3, 5, 6, the piston communication groove 2021 has a depth H2 accounting for 3%-50% of a width W1 of the piston 20. Specifically, when the depth H2 of the piston communication groove 2021 is too small, the fluency of oil liquid transfer during the oil pressing process cannot be effectively improved and the effect of reduction in power consumption of the pump body assembly cannot be achieved. When the depth H2 of the piston communication groove 2021 is too large, the strength of the rotation shaft 30 will be affected, and the rotation shaft 30 is prone to break during its movement with respect to the piston 20.

The pump body assembly in the present disclosure further comprises a cylinder sleeve 40 and a cylinder 10, wherein the cylinder 10 is rotatably arranged in the cylinder sleeve 40 and the cylinder 10 is provided, in its radial direction, with a piston hole 106, the piston 20 is slidably arranged in the piston hole 106, the rotation shaft 30 penetrates through the piston 20 and drives the piston 20 to reciprocate in an extension direction of the piston hole 106, and the cylinder 10 rotates to cause rotation of the piston 20.

Specifically, in the process that the rotation shaft 30 drives the piston 20 to reciprocate in an extension direction of the piston hole 106, the piston 20 presses the oil liquid to achieve the oil pressing process of the pump body assembly. The oil liquid is transferred within two cavities formed by the rotation shaft 30 with the piston 20 and the cylinder 10. By setting the piston communication passage on the piston 20, the impediment of the piston to oil liquid transfer during oil liquid flowing is reduced, thus reducing power consumption of the pump body assembly during the oil pressing process.

As can be seen from the above description, the above embodiment(s) of the present disclosure can achieve the following technical effect(s):

By setting the piston communication passage(s) in the sliding hole 2011 of the piston 20, the fluency of oil liquid flow is improved and the power consumption of the pump body assembly is reduced. Currently, during running of a rotary cylinder compressor, when the rotation shaft 30 of the pump body assembly is sliding with respect to the piston 20, an inner wall of the sliding hole 2011 of the piston 20 will impede fluency of oil liquid flow when pressing the oil liquid and cause increase in power consumption of the pump body assembly.

Specifically, the rotation shaft 30 penetrates through the sliding hole 2011 on the piston 20 and divides the portion inside the piston 20 into two cavities. During movement of the pump body assembly, the piston 20 reciprocates with respect to the rotation shaft 30, and the two cavities increase and decrease periodically to achieve the oil pressing process. During the reciprocating movement of the piston 20, the inner wall of the sliding hole 2011 of the piston 20 will press the oil liquid to enable transfer of the oil liquid between the two cavities. The communication passage communicated with the sliding hole 2011 is disposed on the piston 20 so as to improve fluency of oil liquid transfer, to decrease resistance to pressing oil liquid by the piston 20, to reduce power consumption of the rotation shaft 30 and the piston 20 during the oil pressing process, and to reduce power consumption of the pump body assembly.

In order to solve the problem in prior art of impediment of the piston to oil liquid flow during use of rotary cylinder compressors, the cylinder 10 may be optimized, decreasing a gap between a stop convex ring 1011 on the cylinder 10 and the rotation shaft 30 to reduce impediment of the stop convex ring 1011 of the cylinder 10 to oil liquid and thus reduce power consumption of the pump body assembly.

Specifically, as shown in FIGS. 11-15, the pump body assembly comprises a cylinder 10 and a rotation shaft 30, the cylinder 10 is rotatably arranged and the cylinder 10 is provided, in its axial direction, with a stop convex ring 1011; the rotation shaft 30 penetrates through the stop convex ring 1011 and extends into the cylinder 10, the stop convex ring 1011 is provided, on an inner annular plane on a side facing towards the rotation shaft 30, with an avoidance recess 1012 such that a flow-through gap is formed between the rotation shaft 30 and the avoidance recess 1012.

As can be seen from the above description, in the above embodiment(s) of the present disclosure, by setting the avoidance recess 1012 on the stop convex ring 1011 of the cylinder 10 on the inner annular plane on the side facing towards the rotation shaft 30, the flow-through gap between the rotation shaft 30 and the cylinder 10 is increased and the oil liquid resistance to the rotation shaft 30 and the piston 20 is reduced, thus improving running stability. Currently, in the prior pump body assembly, the flow-through gap formed between the rotation shaft 30 and the inner wall of the stop convex ring 1011 on the cylinder 10 is too small, the piston 20 and the rotation shaft 30 are impeded by the oil liquid during movement, resulting in increased power consumption for oil pressing of the piston 20 and the rotation shaft 30 and also affecting stability of the rotation shaft 30 and the piston 20.

Specifically, the rotation shaft 30 penetrates through the cylinder 10 and the flow-through gap is formed between the rotation shaft 30 and the inner annular plane of the stop convex ring 1011 of the cylinder 10. The avoidance recess 1012 is disposed on the inner annular plane of the stop convex ring 1011 to increase the flow-through gap between the rotation shaft 30 and the cylinder 10 to facilitate flow and transfer of oil liquid, effectively reducing oil liquid resistance to the rotation shaft 30 and the piston 20 during rotation, and preventing the rotation shaft 30 and the piston 20 from increase of power consumption or being unstable due to impediment of oil liquid to the rotation shaft 30 and the piston 20.

As shown in FIGS. 12-15, the avoidance recess 1012 extends to edges on both sides of the stop convex ring 1011 in the axial direction of the rotation shaft 30.

Specifically, the avoidance recess 1012 extends to the edges on both sides of the stop convex ring 1011 to form a gap passage, enlarging the flow-through gap, improving fluency of the oil liquid flowing through the flow-through gap, reducing impediment of oil liquid to the rotation shaft 30, and reducing power consumption of the pump body assembly.

As shown in FIGS. 12-15, the avoidance recess 1012 is an avoidance groove disposed on an inner annular face such that the wall thickness of the portion of the stop convex ring 1011 with the hiding groove is less than that of the portion of the stop convex ring 1011 without the hiding groove.

Specifically, the avoidance recess 1012 is a hiding groove disposed on an inner annular face. The hiding groove is provided to increase the flow-through gap at the hiding groove. During the oil pressing process of the pump body assembly, when the oil liquid is pressed to flow through the hiding groove, the impediment to the oil liquid can be reduced, improving fluency of oil liquid flow and reducing power consumption of the pump body assembly.

In the present disclosure, the flow-through gap is greater than 1 mm and less than 3 mm. The flow-through gap controlled to be within the range from 1 mm to 3 mm can effectively improve fluency of oil liquid flow and reduce power consumption of the pump body assembly. When the flow-through gap is less than 1 mm, it is too small to improve fluency of oil liquid flowing through the flow-through gap and cannot achieve the effect of reduction in power consumption of the pump body assembly. When the flow-through gap is greater than 3 mm, it is too large and will affect the strength of the portion at the stop convex ring 1011 of the cylinder 10, and thus the stop convex ring 1011 is prone to be damaged, resulting in that the problems of inclination and oil leakage are prone to occur to the cylinder 10 during running.

Specifically, the avoidance recess 1012 has a width in a circumferential direction of the inner annular face which equals to 2%-5% of a diameter of the inner annual face. When the width of avoidance recess 1012 in the circumferential direction of the inner annular face is too small, the width of the flow-through gap formed at the avoidance recess 1012 is too small, the fluency of the oil liquid flowing through the flow-through gap cannot be effectively improved, and the effect of reduction in power consumption of the pump body assembly cannot be achieved. When the width of avoidance recess 1012 in the circumferential direction of the inner annular face is too large, the stability of the stop convex ring 1011 of the cylinder 10 will be affected, resulting in that the problems of inclination and oil leakage are prone to occur to the cylinder 10 during running, and also affecting stable running of the pump body assembly.

It should be noted that the width of the avoidance recess 1012 in the circumferential direction of the inner annular face may be changed according to the size of the stop convex ring 1011 on the cylinder 10. For different types of cylinders 10, the corresponding avoidance recesses 1012 having different widths may be provided on the inner annular face of the stop convex ring 1011 of the cylinder 10.

Figure 14:
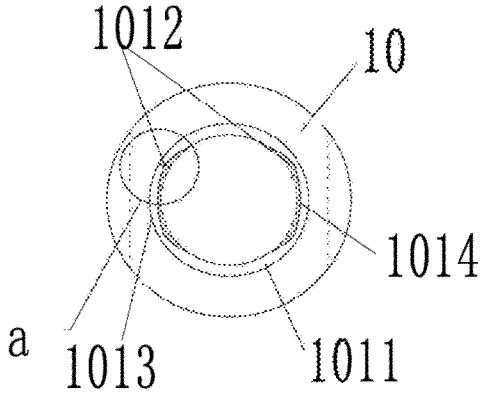
FIG. 14 shows a top view of FIG. 13.
Figure 15:
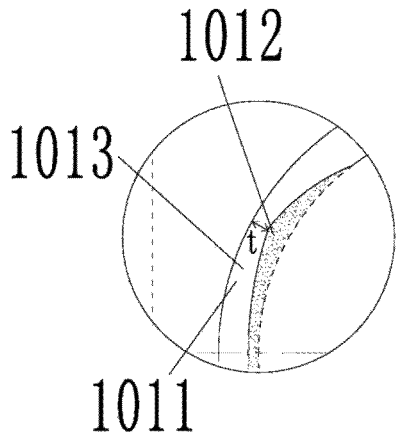
FIG. 15 shows an enlarged view of a in FIG. 14.

As shown in FIGS. 14-15, the flow-through gap is 2%-30% of the diameter of the inner annular face. Specifically, when the pump body assembly is pressing oil, the oil liquid can flow through the flow-through gap to reduce impediment of the stop convex ring 1011 to the oil liquid, thus improving fluency of oil liquid flow and reducing power consumption during the oil pressing process of the pump body. When the flow-through gap is too small, it is too small to improve fluency of the oil liquid flowing through the flow-through gap and cannot achieve the effect of reduction in power consumption of the pump body assembly. When the flow-through gap is too large, it will affect the strength of the portion at the stop convex ring 1011 of the cylinder 10, and thus the stop convex ring 1011 is prone to be damaged, resulting in that the problems of inclination and oil leakage are prone to occur to the cylinder 10 during running, and also affecting stable running of the pump body assembly.

It should be noted that the flow-through gap may be varied according to the size of the stop convex ring 1011 on the cylinder 10. For different types of cylinders 10, the corresponding flow-through gaps may be provided on the inner annular face of the stop convex ring 1011 of the cylinder 10.

As shown in FIG. 15, the stop convex ring 1011 has a minimum wall thickness t greater than or equal to 1 mm at the portion where the avoidance recess 1012 is located. With the stop convex ring 1011 having the wall thickness greater than or equal to 1 mm, during rotation of the cylinder 10, the stop convex ring 1011 has a function of positioning. The stop convex ring 1011 has an influence on the stability of the cylinder 10 and prevents the cylinder 10 from inclination. The stop convex ring 1011 is robust. Therefore, the stop convex ring 1011 has a minimum wall thickness t greater than or equal to 1 mm to ensure strength of the stop convex ring 1011 such that the cylinder 10 can run stably.

As shown in FIGS. 11, 13, 14, and 15, the cylinder 10 is provided thereon, in its radial direction, with a piston hole 106. The inner annular face of the stop convex ring 1011 has a first face segment 1013 and a second face segment 1014 opposite thereto. A connection line of the first face segment 1013 and the second face segment 1014 is perpendicular to an extension direction of the piston hole 106. Each of the first face segment 1013 and the second face segment 1014 is provided with the avoidance recess 1012.

Specifically, the connection line of the first face segment 1013 and the second face segment 1014 of the stop convex ring 1011 of the cylinder 10 is perpendicular to the extension direction of the piston hole 106 on the cylinder 10. The oil liquid flows through the first face segment and the second face segment. Each of the first face segment 1013 and the second face segment 1014 is provided thereon with the avoidance recess 1012. It can improve fluency of oil liquid at the flow-through gap, facilitate oil liquid transfer, and thus reduce power consumption of the pump body assembly.

It should be noted that during mounting of the pump body assembly, the rotation shaft 30 may be close to the first face segment or to the second face segment. Each of the first face segment and the second face segment is provided thereon with the avoidance recess 1012. Therefore, when the rotation shaft 30 is close to either the first face segment or the second face segment, the same technical effect can be achieved, both improving fluency of oil liquid and facilitating mounting.

As shown in FIGS. 11-15, the pump body assembly further comprises a piston 20 provided with a sliding hole 2011, the rotation shaft 30 penetrates through the sliding hole 2011, and a group of face segments of the inner annular face of the stop convex ring 1011 in the extension direction of the sliding hole 2011 are each provided with the avoidance recess 1012.

Specifically, the piston 20 is provided thereon with a sliding hole 2011. The piston 20 moves within the cylinder 10 to achieve oil pressing. The piston 20 presses the oil liquid to enable oil liquid transfer. The oil liquid pressed by the piston 20 will flow through a group of face segments of the stop convex ring 1011 in the extension direction of the sliding hole 2011. The face segments is provided thereon with the avoidance recess 1012. It can reduce oil pressing resistance to the piston 20, reduce vibration of the piston 20, and avoid the problem of damage to the piston 20. Also, the avoidance recess 1012 improves fluency of oil liquid flow, reduces resistance between the rotation shaft 30 and the oil liquid, and reduces power consumption of the pump body assembly. Herein, just another reference is used. The extension direction of the piston hole 106 is previously used as reference, while the extension direction of the sliding hole 2011 is herein used as reference, wherein the extension direction of the piston hole 106 may be same as or perpendicular to the extension direction of the sliding hole 2011. Specifically, it is apparent in FIG. 12 that the extension direction of the piston hole 106 is perpendicular to that of the sliding hole 2011.

Figure 11:
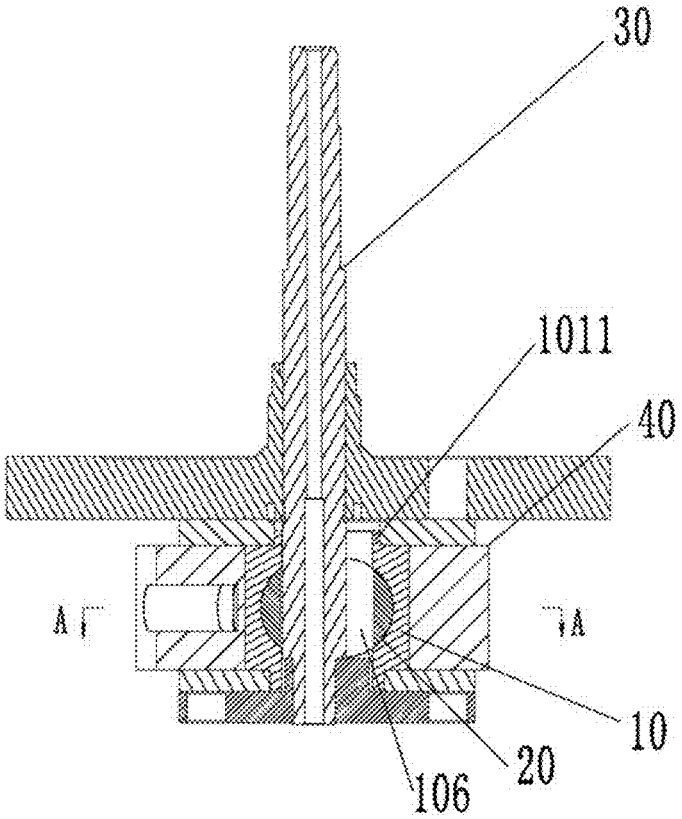
FIG. 11 shows a diagram for mounting relation of various components in the pump body assembly in the present disclosure.
Figure 12:
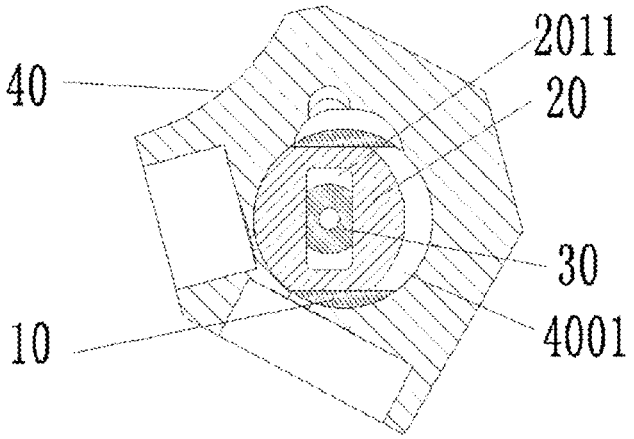
FIG. 12 shows a section view along A-A in FIG. 11.
Figure 13:
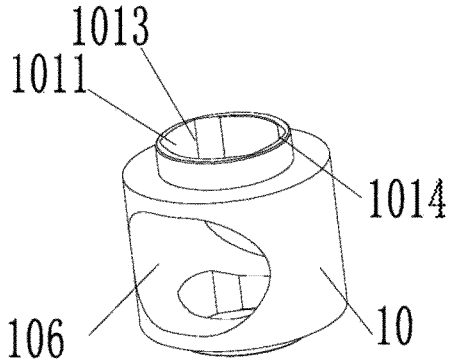
FIG. 13 shows a diagram of an avoidance recess provided on a cylinder in the present disclosure.

As shown in FIG. 11, the pump body assembly further comprises a cylinder sleeve 40 having a volume cavity 4001. The cylinder 10 is rotatably arranged in the volume cavity 4001. The piston 20 is slidably arranged in the piston hole 106 of the cylinder 10. The rotation shaft 30 penetrates through the sliding hole 2011 of the piston 20 and drives the piston 20 to reciprocate in an extension direction of the piston hole 106. The cylinder 10 rotates to cause rotation of the piston 20.

Specifically, the cylinder 10 and the rotation shaft 30 rotate. The cylinder 10 can cause the piston 20 to rotate. The rotation shaft 30 penetrates through the sliding hole 2011 of the piston 20 and divides a volume cavity 4001 inside the cylinder 10 and the piston 20 into two cavities. With the action of the rotation shaft 30, the piston 20 reciprocates within the piston hole 106 in the extension direction of the piston hole 106. The reciprocating movement of the piston 20 causes the two cavities to increase and decrease periodically. Also, the piston 20 presses the oil liquid within the cylinder 10 to achieve periodical transfer of the oil liquid within the two cavities. By setting the avoidance recess 1012 on the inner annular face of the stop convex ring 1011 of the cylinder 10, the impediment of the stop convex ring 1011 to the oil liquid during transfer of the oil liquid can be reduced, improving fluency of oil liquid transfer and reducing power consumption of the pump body assembly.

As can be seen from the above description, the above embodiment(s) of the present disclosure can achieve the following technical effect(s):

By setting the avoidance recess 1012 on the stop convex ring 1011 of the cylinder 10 on the inner annular plane on the side facing towards the rotation shaft 30, the flow-through gap between the rotation shaft 30 and the cylinder 10 is increased and the oil liquid resistance to the rotation shaft 30 and the piston 20 is reduced, thus improving running stability. Currently, in the prior pump body assembly, the flow-through gap formed between the rotation shaft 30 and the inner wall of the stop convex ring 1011 on the cylinder 10 is too small, the piston 20 and the rotation shaft 30 are impeded by the oil liquid during movement, resulting in increased power consumption for oil pressing of the piston 20 and the rotation shaft 30 and also affecting stability of the rotation shaft 30 and the piston 20.

Specifically, the rotation shaft 30 penetrates through the cylinder 10 and the flow-through gap is formed between the rotation shaft 30 and the inner annular plane of the stop convex ring 1011 of the cylinder 10. The avoidance recess 1012 is disposed on the inner annular plane of the stop convex ring 1011 to increase the flow-through gap between the rotation shaft 30 and the cylinder 10 to facilitate flow and transfer of oil liquid, it can effectively reduce oil liquid resistance to the rotation shaft 30 and the piston 20 during rotation, and prevent the rotation shaft 30 and the piston 20 from producing increased power consumption or being unstable due to impediment of oil liquid to the rotation shaft 30 and the piston 20.

In order to solve the problem in prior art of impediment to oil liquid flow during use of rotary cylinder compressors, it is possible to optimize the rotation shaft 30 so as to reduce impediment of the rotation shaft 30 to the fluency of oil liquid flow in the piston 20, thereby reducing power consumption of the pump body assembly.

Specifically, as shown in FIGS. 16-19, a pump body assembly comprises a rotation shaft 30 and a piston 20 provided with a sliding hole 2011, with at least a portion of the rotation shaft 30 penetrating into the sliding hole 2011, during rotation of the piston 20 with the rotation shaft 30, the sliding hole 2011 is in sliding fit with the rotation shaft 30, wherein the rotation shaft 30 is provided, on the shaft segment of the rotation shaft 30 in the sliding hole 2011, with a rotation shaft flow-through passage, and the rotation shaft flow-through passage extends in the sliding direction of the piston 20.

As can be seen from the above description, in the above embodiment(s) of the present disclosure, the rotation shaft 30 is provided, on the shaft segment of the rotation shaft 30 in the sliding hole 2011 of the piston 20, with a flow-through passage, the fluency of oil liquid flow is improved and the power consumption of the pump body assembly is reduced. Currently, during running of a rotary cylinder compressor, when the rotation shaft of the pump body assembly is sliding with respect to the piston, the region of the rotation shaft in the piston impedes flowing of the oil liquid such that the oil liquid impedes movement of the piston and the rotation shaft and the power consumption of the pump body assembly is increased.

Specifically, the rotation shaft 30 penetrates through the sliding hole 2011 on the piston 20 and divides the portion inside the piston 20 into two cavities. During movement of the pump body assembly, the piston 20 reciprocates with respect to the rotation shaft 30, and the two cavities increase and decrease periodically to achieve the oil pressing process. The shaft segment of the rotation shaft 30 in the sliding hole 2011 of the piston 20 will press the oil liquid to enable transfer of the oil liquid within the two cavities. The rotation shaft flow-through passage is disposed on the shaft segment of the rotation shaft 30 in the sliding hole 2011 so as to reduce impediment of the rotation shaft 30 to the oil liquid and reduce power consumption of the piston 20 and the rotation shaft 30 during the oil pressing process, and thus reduce power consumption of the pump body assembly.

Figure 18:
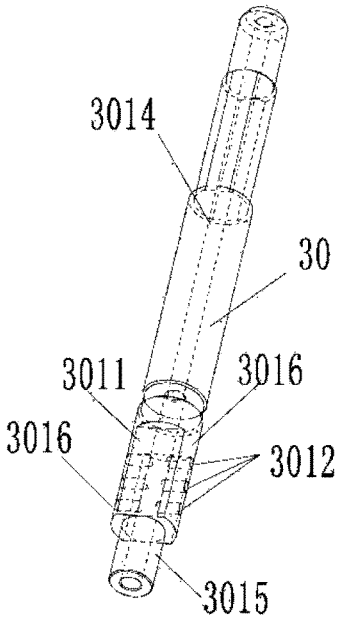
FIG. 18 shows a diagram of a rotation shaft flow-through hole provided in the rotation shaft in the present disclosure.

As shown in FIG. 18, there are a plurality of rotation shaft flow-through passages which are spaced in the axial direction of the rotation shaft 30. By setting a plurality of spaced rotation shaft flow-through passages on the rotation shaft 30, during the oil pressing process, the oil liquid can be transferred via the plurality of rotation shaft flow-through passages, enlarging the flow path and reducing power consumption of the piston 20 and the rotation shaft 30 during the oil pressing process.

In some embodiments, there are less than four rotation shaft flow-through channels. When there are more than 4 flow-through passages, too many rotation shaft flow-through passages will cause decrease in strength of the rotation shaft 30, and during relative movement of the rotation shaft 30 and the piston 20, the rotation shaft 30 is prone to break due to decrease in strength of the rotation shaft 30. With less than 4 rotation shaft flow-through passages, the flow path of the oil liquid is enlarged, without affecting the strength of the rotation shaft 30.

It should be noted that in the specific embodiments as shown in FIGS. 16-19, the rotation shaft flow-through passage is a passage disposed on the rotation shaft 30 to enlarge the flow path of the oil liquid. In the specific implementation(s), there may be multiple specific structures for the rotation shaft flow-through passage as long as the impediment of the rotation shaft 30 to the oil transfer in the sliding hole 2011 of the piston 20 can be reduced, and they will not be described herein one by one.

Hereinafter, according to different structures for the rotation shaft flow-through passage, the following specific implementations are provided for explanation.

Figure 16:
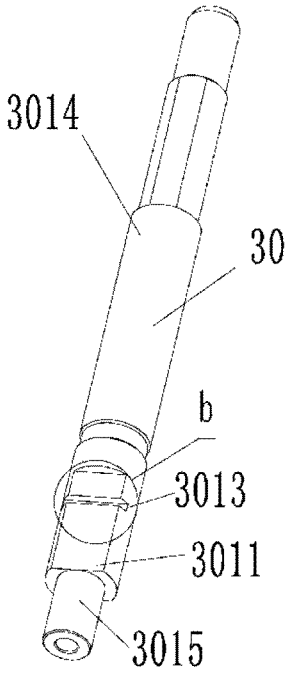
FIG. 16 shows a diagram of a rotation shaft communication groove provided in the rotation shaft in the present disclosure.
Figure 17:
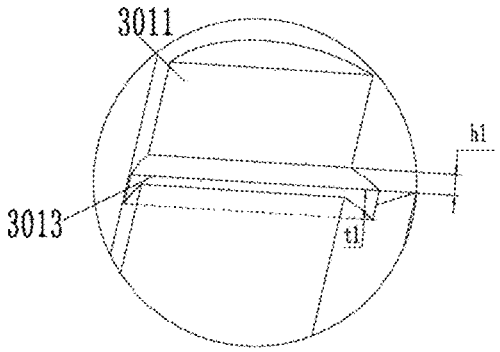
FIG. 17 shows an enlarged view at b in FIG. 16.

In the specific implementations as shown in FIGS. 16-17, the sliding hole 2011 has a group of opposite hole wall faces of the sliding hole 2011. The rotation shaft 30 is provided, on the shaft segment in the sliding hole 2011, with a sliding fit face 3011 cooperating with the hole wall face of the sliding hole 2011. The rotation shaft flow-through passage is a rotation shaft communication groove 3013 and is disposed on the sliding fit face 3011.

Specifically, when the rotation shaft 30 moves with respect to the sliding hole 2011 of the piston 20, the sliding fit face 3011 on the rotation shaft 30 is used to be in relative sliding fit with the hole wall face on the sliding hole 2011. The rotation shaft communication groove 3013 is disposed on the sliding fit face 3011. The sliding fit face 3011 presses the oil liquid during sliding relative to the hole wall face of the sliding hole 2011. The oil liquid can be transferred via the rotation shaft communication groove 3013, decreasing resistance between the rotation shaft 30 and the piston 20 and the oil liquid, and reducing power consumption of the pump body assembly.

It should be noted that the sliding fit face 3011 is a plane. This means that the hole wall face of the sliding hole 2011 is a plane. The sliding fit face 3011 reciprocates with respect to the hole wall face of the sliding hole 2011. The rotation shaft communication groove 3013 is provided on a surface of the sliding fit face 3011.

Figure 19:
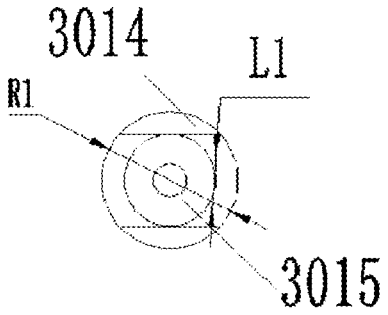
FIG. 19 shows a diagram of a shaft segment of the rotation shaft within a sliding hole in the present disclosure.
Figure 20:
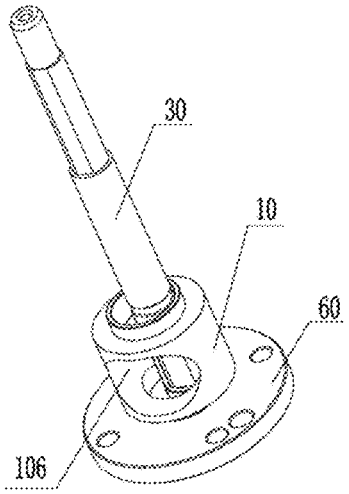
FIG. 20 shows a diagram of mounting relation of the rotation shaft with a cylinder and a lower flange in the present disclosure.
Figure 21:
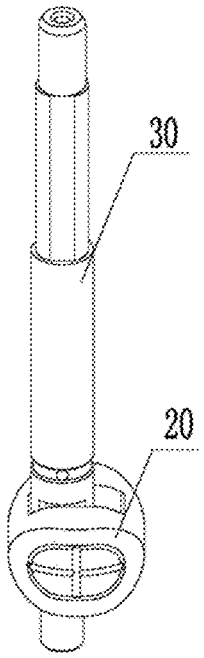
FIG. 21 shows a diagram of mounting relation of the rotation shaft and the piston in the present disclosure.
Figure 22:
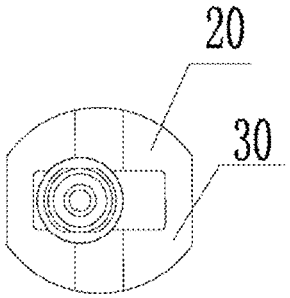
FIG. 22 shows a top view of FIG. 21.
Figure 23:
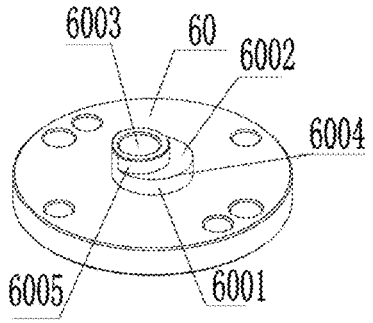
FIG. 23 shows a structural diagram of an avoidance recess provided in a lower flange in the present disclosure wherein the avoidance recess is in a crescent shape and the crescent shape has an outer circle which is concentric with the lower flange.
Figure 24:
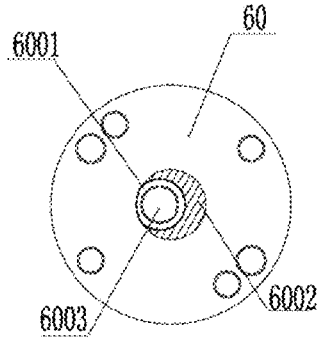
FIG. 24 shows a section view of the avoidance recess in FIG. 23.

As shown in FIGS. 17 and 19, the rotation shaft communication groove 3013 has a width t1 accounting for 5%-20% of a diameter R1 of the shaft segment of the rotation shaft 30 in the sliding hole 2011. When the width t1 of the rotation shaft communication groove 3013 is too small, it cannot effectively improve fluency of oil liquid transfer during the oil pressing process and the effect of reduction in power consumption of the pump body assembly cannot be achieved. When the width t1 of the rotation shaft communication groove 3013 is too large, the strength of the rotation shaft 30 will be affected and the rotation shaft 30 is prone to break during its movement with respect to the piston 20.

It should be noted that the width t1 of the rotation shaft communication groove 3013 may be varied according to different types of the rotation shaft 30 as long as the fluency of oil liquid can be improved and the power consumption of the pump body assembly during the oil pressing process can be reduced.

As shown in FIGS. 17 and 19, the rotation shaft communication groove 3013 has a depth hl accounting for 5%-20% of a diameter R1 of the shaft segment of the rotation shaft 30 in the sliding hole 2011.

Specifically, when the depth hl of the rotation shaft communication groove 3013 is too small, it cannot effectively improve fluency of oil liquid transfer during the oil pressing process and the effect of reduction in power consumption of the pump body assembly cannot be achieved. When the depth h1 of the rotation shaft communication groove 3013 is too large, the strength of the rotation shaft 30 will be affected and the rotation shaft 30 is prone to break during its movement with respect to the piston 20.

It should be noted that the depth h1 of the rotation shaft communication groove 3013 may be varied according to different types of the rotation shaft 30 as long as the fluency of oil liquid can be improved and the power consumption of the pump body assembly during the oil pressing process can be reduced.

In the specific implementation as shown in FIG. 18, the sliding hole 2011 has a group of opposite hole wall faces of the sliding hole 2011. The rotation shaft 30 is provided, on the shaft segment in the sliding hole 2011, with a sliding fit face 3011 cooperating with the hole wall face of the sliding hole 2011. The rotation shaft 30 is further provided, on the shaft segment in the sliding hole 2011, with a group of connection faces 3016, opposite to each other, for connecting two sliding fit faces 3011. The rotation shaft flow-through passage is a rotation shaft flow-through hole 3012, and rotation shaft flow-through hole 3012 penetrates through two connection faces 3016.

Specifically, the rotation shaft 30 penetrates through the sliding hole 2011 of the piston 20 and divides the sliding hole 2011 into two cavities. During the oil pressing process, the oil liquid is transferred between the two cavities. The rotation shaft flow-through hole 3012 is disposed between the two connection faces 3016, so as to improve fluency of oil liquid flow, reduce impediment of oil liquid to the rotation shaft 30 and the piston 20, and reduce power consumption of the pump body assembly during the oil pressing process.

It should be noted that the sliding fit face 3011 is a plane such that a distance L1 between the two sliding fit faces 3011 is greater than a diameter of the rotation shaft flow-through hole 3012 by 2 mm. The sliding fit face 3011 slides with respect to the hole wall face of the sliding hole 2011, with the friction reduced by the planar design, and the distance L1 between the two sliding fit faces 3011 is greater than the diameter of the rotation shaft flow-through hole 3012 by 2 mm, to ensure the strength of the rotation shaft 30, and prevent the rotation shaft 30 from damage or breaking during running due to a too large diameter of the rotation shaft flow-through hole 3012.

In some embodiments, the diameter of the rotation shaft flow-through hole 3012 is greater than or equal to 1 mm. when the diameter of the rotation shaft flow-through hole 3012 is less than 1 mm, the effect of reducing pump body assembly cannot be achieved. In order to improve fluency of oil liquid flow, it is necessary for the diameter of the rotation shaft flow-through hole to be greater than or equal to 1 mm.

As shown in FIGS. 16 and 18, the rotation shaft 30 comprises a long shaft segment 3014 and a short shaft segment 3015 which are connected in sequence, with the long shaft segment 3014 having a length greater than that of the short shaft segment 3015. The long shaft segment 3014 is provided thereon with a sliding fit face 3011. At least a portion of the long shaft segment 3014 extends into the sliding hole 2011.

Specifically, the sliding fit face 3011 on the long shaft segment 3014 is in sliding fit with the hole wall face of the sliding hole 2011 in the piston 20. The rotation shaft flow-through passage is disposed on the long shaft segment 3014 to achieve reduction in power consumption of the rotation shaft 30 and the piston 20 during the oil pressing process.

As shown in FIGS. 16, 18, 19, the diameter of the shaft segment in the sliding hole 2011 is greater than the diameter of the short shaft segment 3015. A stepped shape is formed at an interface between an end face of the shaft segment and the short shaft segment 3015, and a support face is formed at an interface between the end face of the shaft segment and the short shaft segment 3015.

The pump body assembly in the present disclosure further comprises a cylinder sleeve 40, and a cylinder 10 is rotatably arranged in the cylinder sleeve 40. The cylinder 10 is provided thereon, in its radial direction, with a piston hole 106. The piston 20 is slidably arranged in the piston hole 106. The rotation shaft 30 penetrates through the piston 20 and drives the piston 20 to reciprocate in an extension direction of the piston hole 106. The cylinder 10 rotates to cause rotation of the piston 20.

Specifically, during the reciprocating movement of the piston 20 in the extension direction of the piston hole 106 driven by the rotation shaft 30, the piston 20 presses the oil liquid to achieve the oil pressing process of the pump body assembly. The oil liquid is transferred within the two cavities formed by the rotation shaft 30 and the piston 20 and the cylinder 10. The rotation shaft flow-through passage is disposed on the shaft segment of the rotation shaft 30, so as to improve fluency of oil liquid transfer, to reduce impediment of the rotation shaft 30 to oil liquid transfer during flowing of the oil liquid and reduce power consumption of the pump body assembly during the oil pressing process.

As can be seen from the above description, in the above embodiments of the present disclosure, the following technical effects are achieved:

The flow-through passage is disposed on the shaft segment of the rotation shaft 30 in the sliding hole 2011 of the piston 20, so as to improve fluency of oil liquid flow and reduce power consumption of the pump body assembly. Currently, during running of a rotary cylinder compressor, when the rotation shaft 30 of the pump body assembly is sliding with respect to the piston 20, the region of the rotation shaft 30 in the piston 20 impedes flowing of the oil liquid such that the oil liquid impedes movement of the piston 20 and the rotation shaft 30 and the power consumption of the pump body assembly is increased.

Specifically, the rotation shaft 30 penetrates through the sliding hole 2011 on the piston 20 and divides the portion inside the piston 20 into two cavities. During movement of the pump body assembly, the piston 20 reciprocates with respect to the rotation shaft 30, and the two cavities increase and decrease periodically to achieve the oil pressing process. The shaft segment of the rotation shaft 30 in the sliding hole 2011 of the piston 20 will press the oil liquid to enable transfer of the oil liquid within the two cavities. The rotation shaft flow-through passage is disposed on the shaft segment of the rotation shaft 30 in the sliding hole 2011 so as to reduce impediment of the rotation shaft 30 to the oil liquid and reduce power consumption of the piston 20 and the rotation shaft 30 during the oil pressing process, and thus reduce power consumption of the pump body assembly.

In order to solve the problem in prior art of impediment to oil liquid flow during use of rotary cylinder compressors, a flange structure can be optimized to reduce impediment of the flange structure to the piston 20, thereby improving fluency of oil liquid flow to reduce power consumption of the pump body assembly.

Specifically, as shown in FIGS. 20-29, the pump body assembly comprises a cylinder 10 and a flange structure. The cylinder 10 is rotatably arranged. The flange structure is on a side of the cylinder 10 and has a positioning boss 6001 protruding in the cylinder 10. The positioning boss 6001 is provided thereon with an avoidance recess 6002.

As can be seen from the above description, in the above embodiment(s) of the present disclosure, the avoidance recess 6002 is disposed on the positioning boss 6001 to reduce impediment of the flange structure to the flow path and reduce power consumption of the compressor. Currently, the flange structure of the prior pump body seriously blocks the path in the flow path in the cylinder 10 and the piston 20 close to the side of the flange structure such that the frozen oil cannot be smoothly transferred in the flow path, resulting in increase in resistance to the rotation shaft 30 during rotation and increase in power consumption of the compressor. Specifically, when the flange structure is the lower flange 60, the portion in the flow path close to the lower portion is prone to be blocked.

Specifically, the positioning boss 6001 of the flange structure protrudes in the cylinder 10. By setting the avoidance recess 6002 on the positioning boss 6001, the impediment of the positioning boss 6001 to the flow path in the cylinder 10 is reduced. During rotation of the cylinder 10, the oil liquid in the cylinder 10 flows back and forth via the flow path in the cylinder 10. When the oil liquid flows to the positioning boss 6001, the oil liquid can flow along the avoidance recess 6002, increasing the flow volume, thus reducing power consumption of the compressor and also reducing noise and vibration of the compressor.

As shown in FIGS. 23-29, the positioning boss 6001 is concentric with the flange structure. The positioning boss 6001 is formed integrally on the flange structure and is partially protruded in the cylinder 10 to position the cylinder 10 to prevent the cylinder 10 from inclination during rotation. Also, the flange structure has a load bearing ability. When the positioning boss 6001 is concentric with the flange structure, the eccentric force between the positioning boss 6001 and the flange structure is decreased and the stability of the flange structure and the positioning boss 6001 is increased, thus improving running stability of the pump body assembly and also prolonging the service lives of the flange structure and the positioning boss 6001.

As shown in FIGS. 23-29, the flange structure further comprises a flange hole 6003 penetrating through the positioning boss 6001. The flange hole 6003 is eccentric with respect to the center of the flange structure. The pump body assembly further comprises a rotation shaft 30 penetrating through the cylinder 10 and the flange hole 6003.

Specifically, the rotation shaft 30 penetrates through the piston 20 and the cylinder 10, and is inserted in the flange hole 6003. Herein, the flange hole 6003 is eccentric with respect to the positioning boss 6001. The positioning boss 6001 has a function of bearing the rotation shaft 30, and thus the eccentric flange hole 6003 can effectively decrease the concentrated stress between the positioning boss 6001 and the flange structure, which is conducive to prolonging the service life of the flange structure and also convenient to provide the avoidance recess 6002 on the positioning boss 6001. The avoidance recess 6002 enlarges the flow path of the oil liquid, decreases resistance of the oil liquid to the rotation shaft 30, and reduces power consumption of the pump body assembly.

As shown in FIGS. 23-29, the positioning boss 6001 is in a shape of step, and comprises a first segment 6004 and a second segment 6005. The first segment 6004 is far away from the center of the cylinder 10 than the second segment 6005. The outer circumferential face of the first segment 6004 is matched with an inner wall face of the cylinder 10. a surface of the second segment 6005 on the side facing towards the center of the cylinder 10 is used as a support face for supporting the rotation shaft 30 of the pump body assembly. The flange hole 6003 penetrates through the first segment 6004 and the second segment 6005.

Specifically, the second segment 6005 and the first segment 6004 cooperate to form a structure in stepped shape. The outer circumferential face of the first segment 6004 and the inner surface of the cylinder 10 are matched, without affecting rotation of the cylinder 10. An end face of the second segment 6005 facing towards the center of the cylinder 10 supports the rotation shaft 30. The flange hole 6003 and the second segment 6005 are concentric. The first segment 6004 and the second segment 6005 cooperate to form the avoidance recess 6002, thus enlarging the flow path in the cylinder 10, reducing impediment to rotation of the rotation shaft 30, and reducing power consumption of the pump body assembly.

It should be noted that in the specific embodiments as shown in FIGS. 23-29, the first segment 6004 and the second segment 6005 are both circular bosses. During practical production, it is not necessary for both the first segment 6004 and the second segment 6005 to be circular bosses. It is also possible that only one of the first segment 6004 and the second segment 6005 is a circular boss, or it is also possible that none of the first segment 6004 and the second segment 6005 is a circular boss, as long as the first segment 6004 can be matched with the inner face of the cylinder 10 without any impediment and the second segment 6005 can support the rotation shaft 30. As there are various shapes and combination forms for the first segment 6004 and the second segment 6005, no further specific embodiment will be additionally provided herein for explanation.

It should be noted that based on difference in position as disposed for the second segment 6005 with respect to the first segment 6004, it is possible to form various shapes of the avoidance recess 6002. As there are various shape combination forms for the, the combination forms will not be described one by one. Hereinafter, according to different shapes for the avoidance recess 6002, different implementations are provided respectively for explanation.

In the specific implementations as shown in FIGS. 23-27, the first segment 6004 and the second segment 6005 are both circular bosses. The orthographic projection of the second segment 6005 on the first segment 6004 is not completely overlapped with the outer circumference of the first segment 6004, and the avoidance recess 6002 is formed at a stepped face between the outer circumference of the second segment 6005 and the first segment 6004. In this case, the avoidance recess 6002 is a recess in a crescent shape which has an outer circle concentric with the flange structure.

Specifically, the first segment 6004 and the second segment 6005 are both circular bosses. As the avoidance recess 6002 is formed at the stepped face between the outer circumference of the second segment 6005 and the first segment 6004, when the outer circumference of the second segment 6005 is partially overlapped with the outer circumference of the first segment 6004, the avoidance recess 6002 in a crescent shape is formed at the stepped face between the outer circumference of the second segment 6005 and the first segment 6004. The avoidance recess 6002 in the crescent shape enlarges the flow path of the oil liquid, reduces impediment of the oil liquid to the rotation shaft 30, and reduces power consumption of the pump body assembly.

Figure 28:
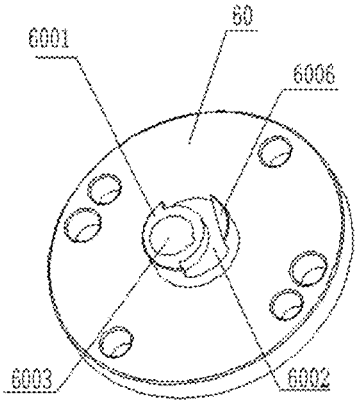
FIG. 28 shows a structural diagram of an avoidance recess provided in a lower flange in the present disclosure wherein the avoidance recess is in an irregular shape.

In the specific implementation as shown in FIG. 28, the first segment 6004 and the second segment 6005 are both circular bosses. The orthographic projection of the second segment 6005 on the first segment 6004 is not completely overlapped with the outer circumference of the first segment 6004. The first segment 6004 is further disposed thereon with a support rib 6006 extending towards a center of the cylinder 10. The support rib 6006 is not higher than the second segment 6005. At least one side surface of the support rib 6006 is flush with the outer circumference of the first segment 6004. The support rib 6006 and the second segment 6005 are spaced apart, and the avoidance recess 6002 is formed between the support rib 6006 and the second segment 6005. In this case, the avoidance recess 6002 has an irregular shape. Herein, in the specific embodiment(s), it is generally possible to select the support rib 6006 having a height same as that of the second segment 6005.

Specifically, with the support rib 6006 disposed on the first segment 6004, the support rib 6006, the first segment 6004 and the second segment 6005 cooperate to form the avoidance recess 6002 in an irregular shape. The avoidance recess 6002 can enlarge the flow path in the cylinder 10, decrease resistance between the rotation shaft 30 and the oil liquid, and reduce power consumption of the pump body assembly. Moreover, with the support rib 6006 added, the stability between the positioning boss 6001 and the cylinder 10 can be improved.

It should be noted that the area of the irregular shape is determined as being not greater than an end area of an end of the first segment 6004 facing towards the center of the cylinder 10.

Figure 29:
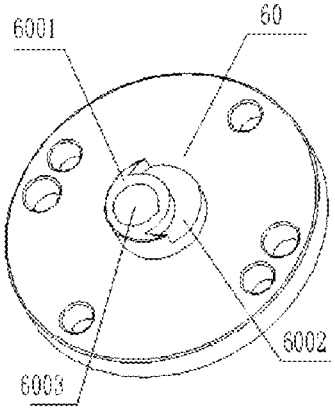
FIG. 29 shows a structural diagram of an avoidance recess provided in a lower flange in the present disclosure, wherein the avoidance recess is in a crescent shape and the crescent shape has an outer circle which is not concentric with the lower flange.

In the specific implementation as shown in FIG. 29, the first segment 6004 and the second segment 6005 are both circular bosses. The orthographic projection of the second segment 6005 on the first segment 6004 is not completely overlapped with the outer circumference of the first segment 6004. The first segment 6004 is further disposed thereon with a support rib 6006 extending towards a center of the cylinder 10. The support rib 6006 is not higher than the second segment 6005. At least one side surface of the support rib 6006 is flush with the outer circumference of the first segment 6004. The support rib 6006 and the second segment 6005 are at least partially connected, and the avoidance recess 6002 is formed between the support rib 6006 and the second segment 6005. In this case, the avoidance recess 6002 has a crescent shape, and the outer circle of the crescent shape is eccentric with respect to the flange structure.

Specifically, with the support rib 6006 added between the second segment 6005 and the first segment 6004, the stability between the positioning boss 6001 and the cylinder 10 can be improved, preventing the cylinder 10 from inclination. Moreover, the avoidance recess 6002 formed between the first segment 6004 and the second segment 6005 can enlarge the flow path in the cylinder 10, decrease resistance between the rotation shaft 30 and the oil liquid, and reduce power consumption of the pump body assembly.

In a specific embodiment not shown, the first segment 6004 and the second segment 6005 are both circular bosses. The orthographic projection of the second segment 6005 on the first segment 6004 is not overlapped at all with the outer circumference of the first segment 6004 such that an avoidance recess 6002 is formed at a stepped face between the outer circumference of the second segment 6005 and the first segment 6004. In this case, the avoidance recess 6002 is an annular recess.

Specifically, the first segment 6004 is not overlapped with the outer circumference of the second segment 6005. An annular avoidance recess 6002 is formed at a stepped face between the outer circumference of the second segment 6005 and the first segment 6004. The annular avoidance recess 6002 can enlarge the flow path, reduce impediment of the flange structure to the flow path, and reduce power consumption of the pump body assembly.

It should be noted that when the avoidance recess 6002 is an annular recess, it is possible for the inner and outer annular faces thereof to be concentric or eccentric. When the inner and outer annular faces are concentric or eccentric, the same technical effect can be achieved. That is, the annular avoidance recess 6002 can enlarge the flow path and reduce impediment of the rotation shaft 30 to the oil liquid. Therefore, the configuration of the inner and outer annular faces, either concentric or eccentric, will not be individually described herein.

Figure 25:
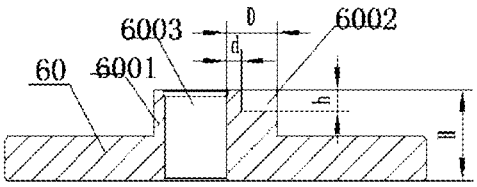
FIG. 25 shows a structural section view of the lower flange in FIG. 23.
Figure 26:
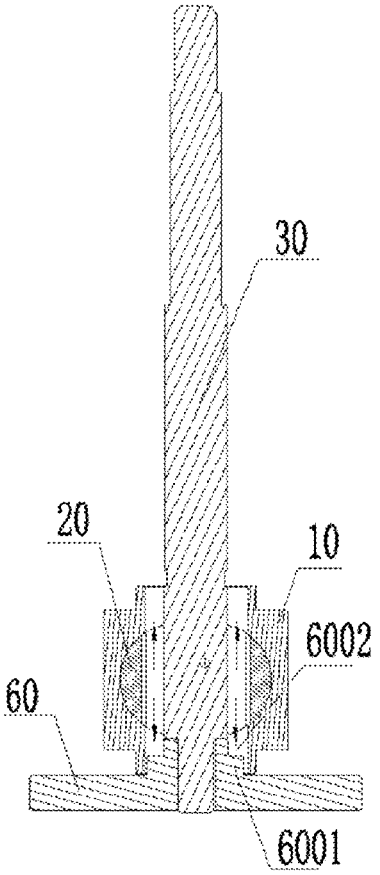
FIG. 26 shows an axial section view of the rotation shaft, a cylinder, a lower flange and the piston in a direction perpendicular to movement of the piston.
Figure 27:
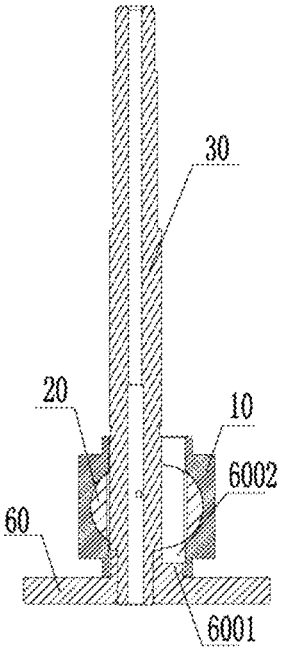
FIG. 27 shows an axial section view of the rotation shaft, a cylinder, a lower flange and the piston in a direction of movement of the piston.

As shown in FIG. 25, the avoidance recess 6002 has a depth h equal to 4%-25% of a diameter of the first segment 6004. Specifically, the depth of the avoidance recess 6002 is limited by the diameter of the first segment 6004, to prevent a too large depth of the avoidance recess 6002 from affecting stability of cooperation of the positioning boss 6001 and the flange structure with the rotation shaft 30 and the cylinder 10. When the depth h of the avoidance recess 6002 equals to 4%-25% of the diameter of the first segment 6004, the avoidance recess 6002 can enlarge the flow path of the oil liquid, decrease resistance to rotation of the rotation shaft 30, and reduce power consumption, without affecting running stability of the pump body assembly.

As shown in FIG. 25, a wall thickness d of the second segment 6005 is 10%-80% of a maximum wall thickness D of the first segment 6004. As the second segment 6005 is eccentric with respect to the flange structure and the first segment 6004 is concentric with respect to the flange structure, the second segment 6005 is thus eccentric with respect to the first segment 6004. It should be noted that when the wall thickness of the second segment 6005 is 10%-80% of the maximum wall thickness of the first segment 6004, the eccentricity ratio of the second section 6005 to the first section 6004 is constant, and will not change with the ratio of the wall thickness of the first segment 6004 to the maximum wall thickness of the second segment 6005. Moreover, the wall thickness of the second segment 6005 is constant while the wall thickness of the first segment 6004 may be changed. By setting the avoidance recess 6002 on the stepped face between the second segment 6005 and the first segment 6004, the effect of enlarging flow path is achieved to reduce power consumption of the pump body.

In some embodiments, the second segment 6005 has a wall thickness d equal to 20%-40% of a maximum wall thickness D of the first segment 6004. Specifically, by further defining the wall thickness d of the second segment 6005 and maximum wall thickness D of the first segment 6004, it can be seen that when the wall thickness d of the second segment 6005 equals to 20%-40% of the maximum wall thickness D of the first segment 6004, the flow-through effect of the oil liquid in the flow path is the best, the resistance of the oil liquid to the rotation shaft 30 is the lowest, and the power consumption of the pump body assembly is the lowest.

As shown in FIG. 25, the avoidance recess 6002 has a depth h equal to 5%-60% of a height H of the flange structure. Specifically, when the depth h of the avoidance recess 6002 is less than 5%-60% of the height H of the flange structure, the depth of the avoidance recess 6002 on the positioning boss 6001 is too small, the first segment 6004 of the positioning boss 6001 will impede flow of the oil liquid in the flow path and the oil liquid will impede rotation of the rotation shaft 30, resulting in increase in power consumption of the pump body assembly. When the depth h of the avoidance recess 6002 is greater than 5%-60% of the height H of the flange structure, the depth of the avoidance recess 6002 on the positioning boss 6001 is too large, resulting in decrease in strength of the positioning boss 6001 and decrease in stability of the pump body assembly during running, and the displacement the rotation shaft 30 and the cylinder 10.

In some embodiments, the avoidance recess 6002 has a depth h equal to 15%-35% of a height H of the flange structure. Specifically, the depth h of the avoidance recess 6002 equal to 15%-35% of the height H of the flange structure is the further definition to the depth h of the avoidance recess 6002 equal to 5%-60% of the height H of the flange structure. When the depth h of the avoidance recess 6002 equals to 15%-35% of the height H of the flange structure, the avoidance recess 6002 can effectively enlarge the flow path of the oil liquid, reduce impediment of the oil liquid to the rotation shaft 30 during its rotation, and reduce power consumption of the pump body assembly.

The flange structure in the present disclosure comprises a lower flange 60. The rotation shaft 30 has a long shaft segment and a short shaft segment, with the long shaft segment having a diameter greater than that of the short shaft segment, such that a rotation shaft support face is formed at an interface between the long shaft segment and the short shaft segment. The rotation shaft support face is supported at the positioning boss 6001. The short shaft segment penetrates into the lower flange 60.

Specifically, the second segment 6005 of the positioning boss 6001 on the supports the support face of the rotation shaft 30. During rotation of the rotation shaft 30, the avoidance recess 6002 on the lower flange 60 enlarges the flow path of the oil liquid in the cylinder 10, resulting in reduction in impediment of the oil liquid to the rotation shaft 30 and reduction in power consumption.

The pump body assembly in the present disclosure further comprises a cylinder sleeve having a volume cavity in which the cylinder 10 is rotatably arranged. The cylinder 10 is provided, in its radial direction, with a piston hole 106, the piston 20 is slidably arranged in the piston hole 106, the rotation shaft 30 penetrates through the piston 20 and drives the piston 20 to reciprocate in an extension direction of the piston hole 106, and the cylinder 10 rotates to cause rotation of the piston 20. The flange structure is located at an end of the cylinder sleeve in its axial direction, and at least a portion of the rotation shaft 30 penetrates into the flange structure.

Specifically, the cylinder 10 in the cylinder sleeve is rotated synchronously with the rotation shaft 30. The piston 20 reciprocates in the piston hole 106. The relative movement between the piston 20 and the rotation shaft 30 enables oil liquid transfer within two flow paths formed by cooperation of the cylinder 10, the piston 20 and the rotation shaft 30. The two flow paths increase and decrease periodically with the reciprocating movement of the piston 20 to drive oil liquid transfer. The avoidance recess 6002 disposed on the positioning boss 6001 of the lower flange 60 can reduce impediment of the positioning boss 6001 to oil liquid flow in the flow path(s), decrease resistance between the rotation shaft 30 and the oil liquid, and reduce power consumption of the pump body assembly.

As can be seen from the above description, the above embodiment(s) of the present disclosure can achieve the following technical effect(s):

By setting the avoidance recess 6002 on the positioning boss 6001, the impediment of the flange structure to the flow path is reduced and the power consumption of the compressor is reduced. Currently, the flange structure of the prior pump body seriously blocks the lower portion of the flow path in the cylinder 10 and the piston 20 such that the frozen oil cannot be smoothly transferred in the flow path, resulting in increase in resistance to the rotation shaft 30 during rotation and increase in power consumption of the compressor.

Specifically, the positioning boss 6001 of the flange structure protrudes in the cylinder 10. By setting the avoidance recess 6002 on the positioning boss 6001, the impediment of the positioning boss 6001 to the flow path in the cylinder 10 is reduced. During rotation of the cylinder 10, the oil liquid in the cylinder 10 flows back and forth via the flow path in the cylinder 10. When the oil liquid flows to the positioning boss 6001, the oil liquid can flow along the avoidance recess 6002, increasing the flow volume, thus reducing power consumption of the compressor and also reducing noise and vibration of the compressor.

Apparently, the embodiments as described above are only some embodiments of the present disclosure, rather than all embodiments. Any other embodiments obtained by those skilled in the art, based on the embodiments in the present disclosure and without any inventive work, will fall within the protection scope of the present disclosure.

It should be noted that the terms as used herein are only for describing specific implementations, and are not intended to limit the exemplary implementations according to the present application. As used herein, the singular form is intended to comprise the plural form, unless otherwise specified in the context. In addition, it should be understood that when the terms of "comprise" and/or "include" are/is used in the present description, it means that there are a feature, a step, an operation, a device, a component, and/or the combinations thereof.

Those as described above are only the preferred embodiments of the present disclosure, and are not used for limiting the present disclosure. For those skilled in the art, there may be various modifications and changes for the present disclosure. Any modification, equivalent substitution or improvement made within the spirit and principle of the present disclosure should be incorporated in the protection scope of the present disclosure.

Apparently, the embodiments as described above are only some embodiments of the present disclosure, rather than all embodiments. Any other embodiments obtained by those skilled in the art, based on the embodiments in the present disclosure and without any inventive work, will fall within the protection scope of the present disclosure.

It should be noted that the terms as used herein are only for describing specific implementations, and are not intended to limit the exemplary implementations according to the present application. As used herein, the singular form is intended to comprise the plural form, unless otherwise specified in the context. In addition, it should be understood that when the terms of "comprise" and/or "include" are/is used in the present description, it means that there are a feature, a step, an operation, a device, a component, and/or the combinations thereof.

It should be noted that the terms of 'first", "second" and the like in the description and claims and the above figures of the present application are used for distinguishing similar objects, rather than describing a specific order or sequence. It is understandable that such data as used may be exchanged under a suitable condition such that the implementations of the present application as described herein can be implemented in an order other than those depicted or described herein.

What is claimed is:

1. A pump body assembly, comprising:

a rotation shaft; and a piston provided with a sliding hole, wherein at least a portion of the rotation shaft penetrates into the sliding hole, during rotation of the piston with the rotation shaft, the sliding hole is in sliding fit with the rotation shaft, and the piston is provided with at least one piston communication passage communicated with the sliding hole;

in an axial direction of the rotation shaft, the piston is provided on its end face with a piston communication groove, and the piston communication groove extends in a sliding direction of the piston and constitutes the at least one piston communication passage; and the sliding hole of the piston is further provided therein with at least one flexible groove, the at least one flexible groove extends in the axial direction of the rotation shaft, and the at least one flexible groove is communicated at its end with the piston communication groove.

2. The pump body assembly according to claim 1, wherein the at least one piston communication passage comprises a plurality of the piston communication passages.

3. The pump body assembly according to claim 1, wherein on the end face of the same end of the piston, a group of two opposite edges of the sliding hole is respectively provided with at least one piston communication groove(s).

4. The pump body assembly according to claim 1, wherein the end face of the piston comprises: a top end face and a bottom end face; and in the axial direction of the rotation shaft, the piston is provided, at its top end face and its bottom end face, with the piston communication groove.

5. The pump body assembly according to claim 1, wherein with the piston communication groove as a boundary, the end face on a side of the piston where the piston communication groove is located comprises a first surface and a second surface, wherein the first surface is in a region between the piston communication groove and an edge of the sliding hole on the side where the piston communication groove is located, and the second surface is in a region between the piston communication groove and an outer edge of the piston.

6. The pump body assembly according to claim 1, wherein the at least one flexible groove is located at an end of the piston communication groove.

7. The pump body assembly according to claim 6, wherein the at least one flexible groove comprises a plurality of the flexible grooves, and both ends of the same piston communication groove are respectively provided with one flexible groove such that a sliding boss protruding from the hole wall face of the sliding hole is formed within the sliding hole.

8. The pump body assembly according to claim 1, wherein the flexible groove penetrates through the piston along the axial direction of the rotation shaft.

9. The pump body assembly according to claim 1, wherein the flexible groove comprises a first groove surface and a second groove surface which are connected in sequence, and the second groove surface is closer to a middle portion of the sliding hole than the first groove surface, wherein a first transition fillet angle 1 is formed between the first groove surface and a hole wall face of the sliding hole, a second transition fillet angle 2 is formed between the second groove surface and the first groove surface, and a third transition fillet angle 3 is formed at an edge on a side of the second groove surface spaced apart from the first groove surface.

10. The pump body assembly according to claim 1, wherein the piston communication groove has a width accounting for 1%-12% of a width of the piston.

11. The pump body assembly according to claim 1, wherein the piston communication groove has a depth accounting for 3%-50% of a width of the piston.

12. The pump body assembly according to claim 1, further comprising:

a cylinder sleeve; and a cylinder, wherein the cylinder is rotatably arranged in the cylinder sleeve and the cylinder is provided thereon, in its radial direction, with a piston hole, the piston is slidably arranged in the piston hole, the rotation shaft penetrates through the piston and drives the piston to reciprocate in an extension direction of the piston hole, and the cylinder rotates to cause rotation of the piston.

13. A fluid machine, comprising the pump body assembly according to claim 1.

* * * * *